US005332120A

United States Patent [19]

D'Andrade et al.

[11] Patent Number: 5,332,120

[45] Date of Patent: * Jul. 26, 1994

[54] WATER ARROW PROJECTING BOW

[76] Inventors: Bruce M. D'Andrade, 3 Ten Eyck Rd., Whitehouse Station, N.J. 08889; Lonnie G. Johnson, 4030 Ridgehurst Dr., Smyrna, Ga. 30080

[ * ] Notice: The portion of the term of this patent subsequent to Dec. 24, 2008 has been disclaimed.

[21] Appl. No.: 902,089

[22] Filed: Jun. 22, 1992

Related U.S. Application Data

[63] Continuation-in-part of Ser. No. 841,762, Feb. 28, 1992, Pat. No. 5,150,819, which is a continuation of Ser. No. 680,247, Apr. 3, 1991, abandoned, which is a continuation-in-part of Ser. No. 578,145, Sep. 6, 1990, Pat. No. 5,074,437.

[51] Int. Cl.[5] ..... A63H 33/30; A63H 33/18; B67D 3/00

[52] U.S. Cl. ..... 222/78; 222/401; 222/517; 446/473

[58] Field of Search ..... 222/78, 79, 130, 325, 222/396, 400.7, 400.8, 401, 517; 42/54; 273/349; 446/473, 475; 124/70, 73; 239/99

[56] References Cited

U.S. PATENT DOCUMENTS

| | | | |
|---|---|---|---|
| 2,589,977 | 3/1952 | Stelzer | 222/79 |
| 3,197,070 | 7/1965 | Pearl et al. . | |
| 3,877,611 | 4/1975 | Morrison et al. . | |
| 4,214,674 | 7/1980 | Jones et al. . | |
| 4,735,239 | 4/1988 | Salmon et al. . | |
| 4,854,480 | 8/1989 | Shindo . | |
| 4,911,364 | 3/1990 | Irie . | |
| 5,074,437 | 12/1991 | D'Andrade et al. | 222/401 X |
| 5,150,819 | 9/1992 | Johnson et al. | 222/79 |
| 5,184,755 | 2/1993 | Brovelli | 222/401 X |
| 5,184,756 | 2/1993 | Amron | 222/79 |

*Primary Examiner*—Gregory L. Huson
*Attorney, Agent, or Firm*—Kenneth P. Glynn

[57] ABSTRACT

The present invention is a toy water bow which is operated by selectively releasing water from a water reservoir that is pressurized with air. The present invention is a toy device formed in the general shape of an archery bow that has a manually operated air pump incorporated into it. The air pump pressurizes a water reservoir and consequently exerts pressure on water contained therein. The pressurized air and water have an avenue of release that is regulated by a pull mechanism of the invention. When no force is applied to the pull mechanism, the pressurized air and water are held at bay with no means of release from the reservoir. When force is applied to the pull mechanism in a predetermined manner, water is released from the pressurized reservoir and is channeled through a narrow nozzle. The escape of the water through the narrow nozzle creates a stream of propelled water in the form of an "arrow" of predetermined length. The shooting may be repeated until the water is consumed or until the pressure of the reservoir equals that of the ambient air.

20 Claims, 1 Drawing Sheet

WATER ARROW PROJECTING BOW

REFERENCES TO RELATED CASES

This application is a continuation-in-part of copending U.S. patent application Ser. No. 07/841,762, filed on Feb. 28, 1992 by Bruce M. D'Andrade and Lonnie G. Johnson, for "Double Tank Pinch Trigger Pump Water Gun", now U.S. Pat. No. 5,150,819, which is a File Wrapper Continuation of U.S. patent application Ser. No. 07/680,247, filed on Apr. 3, 1991, having the same inventors and title, and now abandoned, which is a continuation-in-part of previously copending U.S. patent application Ser. No. 07/578,145, filed on Sep. 6, 1990, having the same inventors, for "Pinch Trigger Pump Water Gun", now U.S. Pat. No. 5,074,437, issued on Dec. 24, 1991.

BACKGROUND OF THE INVENTION

1. Field of the Invention

The present invention is directed toward a pressurized toy water gun bow for projecting water arrows and more particularly to such toy water gun bows that use self-contained means of pressurizing a water reservoir with air, creating a pressure differential between the contained water and the ambient atmosphere and utilizing this pressure differential to propel water from the toy in a predetermined manner to create an "arrow" of water.

2. Prior Art Statement

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Such pump action water guns work, but the guns are limited in the distance the water traveled, the amount of water projected and the duration of the pumping cycle. In an attempt to improve upon water guns, the toy industry has developed pressure activated water guns. Such pressure water guns work upon the principle of pressure differentials between the water held within the toy and the atmosphere. The water within the toy is held at a pressure higher than that of the ambient air. As a result, when the water within the toy is given an avenue of escape, the water will stream out under pressure.

Two primary types of pressure activated water toys exist. The first type is when the water itself is worked to a pressure higher than that of the ambient air. This type of water gun is exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured area. Once the confined area is fully collapsed, the re-expansion of the area draws forth more water from a reservoir, thus priming the water gun for another cycle.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clapping device activated by a trigger. The water gun is used by selectively releasing the water from the expanded bladder.

The second type of pressure activated water toys are toys that use air pressure to force water through squirt channels. Such toys that use this technology are exemplified by U.S. Pat. No. 4,214,674 to Jones et al. The Jones patent shows a two piece apparatus consisting of a pressurized water reservoir and a discharging gun. The Jones patent has a hand operated air pump but differs from the present invention in that it is not a bow, it does not have a one piece self-contained pressurization system, and it lacks the valve configuration needed to support such a self-contained system. Additionally, the present invention has the capability of working at very high pressures and incorporates safety criteria into its design to eliminate the inherent dangers of high pressure liquids.

U.S. Pat. No. 4,911,364 is directed to a water gun which is encompassed in a bow handle and utilizes a bow string to impart strong force to fire the gun. It does not utilize increased air pressure on water to propel water by opening a release means.

U.S. Pat. No. 3,877,611 covers a combination bow/-water gun and includes water storage in the bow handle. It fires a slug of water using a plunger but does not use air to pressurize water in its storage reservoir nor utilize a pull mechanism to open a release means upon release of the pull mechanism.

Thus, the prior art does teach the use of toy water guns that operate by the pressurization of stored water, but the prior art does not teach or suggest a toy water gun bow that has a self-contained means of pressurizing stored water with air, and has a valve configuration that allows pressuring inlet air and exiting pressurized air and water to exit the stored water reservoir through and by the same opening. Thus, the water gun of the present invention may be a one piece unit with a high pressurization capacity which results in ease of both use and manufacture. Also, the prior art fails to teach or suggest the use of highly pressurized air with toy water gun bows and fails to recognize the needed design criteria and safety allowances to eliminate the traditional hazards of producing, storing and discharging high pressure liquids.

SUMMARY OF THE INVENTION

The present invention is a toy water bow which is operated by selectively releasing water from a water reservoir that is pressurized with air. The present invention is a one piece device formed in the general shape of an archery bow that has a manually operated air pump incorporated into it. The air pump pressurizes a water reservoir and consequently exerts pressure on water contained therein. The pressurized air and water have an avenue of release that is regulated by a pull mechanism of the invention. When no force is applied to the pull mechanism, the pressurized air and water are held at bay with no means of release from the reservoir. When force is applied to the pull mechanism in a predetermined manner, water is released from the pressurized reservoir and is channeled through a narrow nozzle. The escape of the water through the narrow nozzle creates a stream of propelled water in the form of an "arrow" of a predetermined length. The shooting may be repeated until the water is consumed or until the pressure of the reservoir equals that of the ambient air.

BRIEF DESCRIPTION OF THE DRAWINGS

The invention will be more fully understood by referring to the following detailed specifications, the above specification and the claims set forth herein, when taken in connection with the drawing appended hereto, wherein:

DETAILED DESCRIPTION OF THE PRESENT INVENTION

Figure 1:
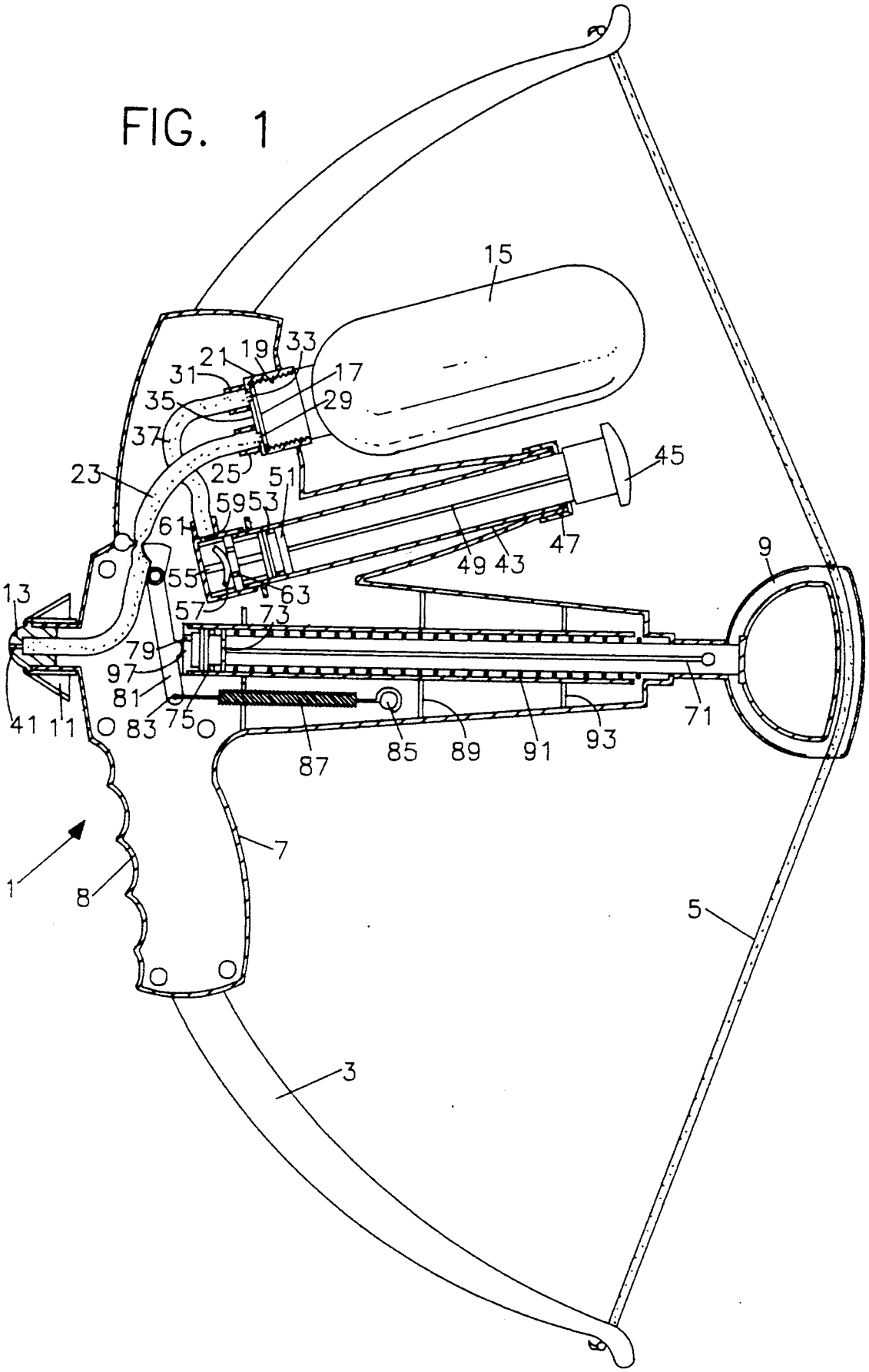
FIG. 1 shows a vertical cross-sectional of one preferred embodiment of the present invention.

The present invention is, as mentioned, directed toward a toy water gun bow that uses air to pressurize water in a storage reservoir and to propel the water through a narrow nozzle. Pressurized water toys are not new; they have been in existence for decades. Water pressure has been used in the toy industry for everything from launching toy rockets to propelling toy cars. Pressurized water toys come in two primary types. First are water toys that use mechanical means to directly compress and pressurize water. Such toys represent a majority of the water toys manufactured today, and are exemplified by traditional water guns that use a trigger operated pump or a battery powered motor to squirt small amounts of water.

The problem with toys that directly pump water is that to achieve the required pressure for a satisfactory squirt, a small diameter piston is required. This in turn limits the amount of water that can be squirted in each shot. In addition, the speed at which the pump is activated, whether manually or by motor, affects the distance of the shot, and it requires many cycles to project any significant amount of water.

To solve these, toy manufacturers have turned to the technology of compressed air to pressurize a reservoir of water. Air is compressed to high pressures and this high pressure can be transferred to stored water. This technology is easily adapted to a child's strength and allows a relatively large amount of water to be pressurized at one time. This large reserve of pressurized water allows a water gun to fire a large continuous stream of water at one time without the need for repeated pumping cycles.

The problem with air pressurized toys is one of safety. Toys are designed to be inexpensive so as to be widely marketable. As such, most toys are made of plastics or other inexpensive materials. Such materials do not have large tensile strengths or fatigue characteristics, and therefore do not lend themselves well to containing pressurized fluids. Plastic containments of pressurized liquids, if not properly designed, can rupture and explode causing severe injury. The present invention has a unique design that allows for both the use of high pressure air and the elimination of potential rupturing hazards. The present invention has a cylindrical water reservoir which is attached to the housing of the bow. There is a single orifice, in conjunction with the generous radii used at the cylinder ends, to serve to maintain the integrity of the water reservoir walls and minimize the leak points throughout the material of the water reservoir at its connection to the housing, allowing for the safe use of high pressures while relying upon a single orifice for pressurizing air to enter and pressurized air and water to exit the reservoir. The present invention was designed so that both the pressurized air from the air pump and the exiting pressurized water utilize the same opening without back flow problems to either. Additionally, since the water reservoir must be periodically refilled with water, a separate fill cap may be used, or in a preferred embodiment, the water reservoir has only one opening and is designed to detach from the air pump inlet and the pressurized water outlet so that ambient pressure water can be added.

The present invention is generally a toy device formed in the general shape of a bow that has a manually operated air pump incorporated into the design. The air pump pressurizes a water reservoir and consequently pressurizes the air so as to exert pressure on water contained therein. The pressurized air and water have an avenue of release that is regulated by a water release means which itself is actuated by a pull mechanism of the invention. When no force is applied to the water release means, the pressurized water is held at bay with no means of release from the reservoir. When force is applied to the water release means via the pull mechanism, water is released from the pressurized container and is channeled through a narrow nozzle. The escape of the pressurized water through the narrow nozzle creates a stream of propelled water that lasts for a predetermined amount of time, e.g. by regulation of recovery of closure of the water release means. Repeat shots can be made until the water supply is exhausted or until the pressure of the water equals that of the ambient air. Water is added to the present invention by removing either a fill cap or the entire water reservoir from the gun, filling the reservoir and reattaching the cap or reservoir. Upon reattachment, there is an orifice which serves as both the entrance point of pressurized air from the air pump, and the exit point of the pressurized air and water. This single orifice water reservoir exit design holds the integrity of the reservoir's walls intact, allowing the water reservoir to hold high pressures without fear of rupture. Additionally, the danger of rupture is eliminated by a release means device that automatically and safely discharges pressurized water when over pressurized, until the maximum allowable pressure is reached.

The present invention water gun bow is, as mentioned, operated by releasing the pressurized water through a narrow nozzle. The release of the pressurized water is controlled by the pull mechanism which actuates the water release means. Since the present invention has the ability to operate at high pressures, the water release means performs two functions. First, it controls the amount of water released and, second, it serves as a safety valve. The release means of the present invention pinches the exit hosing for the pressurized water. The pinching force is created by a spring. When the water release means is actuated, the spring bias of the pinching member is overcome and water is released. Similarly, when the pressure in the water reservoir reaches beyond safety limitations, the force of the compressed air will overcome the spring bias of the pinching member allowing air and/or water to be released until the pressure within the reservoir reaches a safe level.

Referring now to FIG. 1, there is shown a vertical cross-sectional view of one preferred embodiment of the present invention toy water gun bow 1 in the general shape of a bow, having a main housing 7 with extending bow arms such as arm 3, bow string 5 and pull mechanism handle 9. The detachable water storage reservoir 15 is held to the main housing 7 via an attachment collar 19 and reservoir mount 21. The air pump of the present invention is embodied within the main housing 7 but the handle to the pump is a slider handle 45 attached to the piston rod 49 that travels along, and is guided by the piston cylinder 43.

To fill the water reservoir 15 with water, the water reservoir 15 must be detached from the main housing 7 by unscrewing the threaded collar 19 from the sympathetically threaded reservoir mount 21. Water is then placed into the reservoir 15 and the water reservoir 15 is rethreaded into position. Once filled with water, the toy water gun bow 1 is operated by pressurizing the water reservoir 15 with air. Air is forced into the reservoir by the relative movement of the piston 51 within the air pump cylinder 43. The piston 51 is operated by the pump rod 49 that connects the piston 51 to the slider handle 45. The slider handle 45 is operated manually by the user of the toy water gun bow 1. A user holds the slider handle 45 with one hand and the bow 1 at grip handle 8 with the other. The slider handle 45 is then moved back and forth along the length of the cylinder 43. The back and forth action is transferred to the piston 51, which forces air past an O-ring valve 53 and through openings, such as orifice 63, and through a one way flow valve 57, which seats on rest 55. The air exits at opening 59, through connector 61, flexible inlet tube 37 (connected to mount 21 at coupler 31) into inlet orifice 33, single orifice 17 and into the water reservoir 15. Air is continuously added to the water reservoir 15 until a desired pressure is reached.

Once under pressure, the water in reservoir 15 is prevented from flowing freely through the outlet tube 23 by a pinch bar 81 that clamps the outlet tube 23 against a stop 82 that is part of the main housing 7. The pinch bar 81 is biased against the outlet tube 23 by a calibrated spring 87. The spring is held at one end by a formation 85 of the main housing 7 and at the other end to pinch bar 81 at opening 83. The strength of the spring 87 in its biased configuration is calibrated, so that when the pressure on the water within reservoir 15 and within the outlet tube 37 reaches a predetermined maximum valve, the spring 87 will allow the pinch bar 81 to rise (open) and water will be released until safe pressure is maintained.

Absent an automatic water release for an overly high pressure, water is released in the following manner. The user holds housing 7 at handle 8 in one hand and pulls on pull mechanism handle 9 and this compresses spring 91 via piston rod 71 and piston 73. O-ring 75 allows air into cylinder 93 but not out and thus acts as a one way valve. When handle 9 is released, bow string 5 and spring 91 push the handle 9, piston rod 71 and piston 73 inward compressing air and pushing plunger 97. Plunger 97 is connected to cylinder 93 so cylinder and plunger move together to push against pinch bar. Plunger 97 pushes against pinch bar 81 to open outlet tube 23 as the transferred force applied to the pinch bar 81 acts in opposition to the biasing force of spring 87. When the force of the plunger 97 overcomes the force of the spring 87 the pinch bar 81 is lifted from the outlet tube 23 and water is allowed to pass through the outlet tube 23. The outlet tube 23 terminates at a nozzle head 13 attached to housing 7 by nozzle housing 11 (preferably in the shape of an arrow head). Water streams out of the narrow opening 41 as long as compressed air remains between piston 73 and plunger 97. The compressed air is allowed to leak through opening 79. After all compressed air has leaked out then pinch bar and spring 87 return plunger 97 to the at rest position and exerts pressure by way of the pinch bar to the outlet tube. Opening 79 in plunger 97 is calibrated to retain enough compressed air to move plunger 97 and to leak the air for a length of time so a slug of water is ejected for a predetermined amount of time in the form of an "arrow" shot.

It is understood that although the invention described within the above specification shows the best known mode of the present invention, the invention may be formed, shaped, practiced, or made of differing materials than is specifically described within. For example, the pull mechanism could open the pinch bar or other release means upon pulling instead of releasing so as to allow the user to control the duration of the shot. Likewise, other release means than a pinch bar could be used, e.g. a gate valve or other valve or closing mechanism. Also, the storage reservoir could be of a different shape and could be integrated further into the design, and/or multiple tanks could be used.

Further, as used in this invention, the claimed storage reservoir could be used in conjunction with an alternative water source.

Other variations should be deemed to now be within the purview of the artisan without exceeding the scope of the invention.

What is claimed is:

1. An air pressurized toy water bow for firing water, which comprises:

(a) a housing shaped generally like an archery bow;

(b) a water storage reservoir for storing water, attached to said housing and having an orifice through which water and gasses pass from said reservoir to said housing;

(c) an attachment means located on said water bow housing for attaching said water storage reservoir to said water bow housing with a seal impervious to water;

(d) a pressurizing means for pressurizing said water storage reservoir with air, said means being an integral part of said water bow housing and remotely located from said water storage reservoir;

(e) an avenue of release for any stored water displaced by said pressurized air, said avenue of release extending from said attachment means to a nozzle on said bow housing;

(f) a water release means for regulating the fluid flow through said avenue of release, said water release means being attached to said housing and attached to a pull mechanism and actuated by the movement of said pull mechanism;

(g) a pull mechanism attached to said housing and functionally connected to said release means such that movement of said pull mechanism will actuate said water release means; and, (h) a nozzle located on said housing, said nozzle being connected to said avenue of release.

2. The bow of claim 1, wherein said water storage reservoir is adapted to hold at least 100 pounds per square inch of pressure.

3. The bow of claim 1, wherein said means for pressurizing said water storage reservoir is a hand operated air pump.

4. The bow of claim 1, further including a bow string, wherein said pull mechanism is attached to said bow string and said pull mechanism and bow string may be pulled and released together to actuate said water release means.

5. The bow of claim 1, wherein said nozzle is positioned on said housing in a central location to simulate the positioning of an arrow.

6. The bow of claim 1, wherein said avenue of release is a flexible tube connecting said attachment means with said nozzle.

7. The bow of claim 6, wherein said water release means is a spring-biased pinch bar that clamps said avenue of release against said housing, collapsing said avenue of release and thus restricting the fluid flow therethrough.

8. The bow of claim 7, wherein pinch bar has a spring with a spring bias which is overcome by a force applied to said pinch bar in a direction away from said spring through the action of said pull mechanism.

9. The bow of claim 8, wherein said spring bias is calibrated to yield to pressure within said avenue of release, when said pressure within said avenue of release exceeds a predetermined value.

10. The bow of claim 8, wherein said spring bias is formed by an extension spring having two ends, one end being anchored to said housing and said second end anchored to said pinch bar.

11. An air pressurized toy water bow for firing water, which comprises:

(a) a housing shaped generally like an archery bow;

(b) a water storage reservoir for storing water, attached to said housing and having an orifice through which water and gasses pass from said reservoir to said housing;

(c) an attachment means located on said water bow housing for attaching said water storage reservoir to said water bow housing with a seal impervious to water;

(d) a pressurizing means for pressurizing said water storage reservoir with air, said means being an integral part of said water bow housing;

(e) an avenue of release for any stored water displaced by said pressurizing air, said avenue of release being a flexible tube extending from said attachment means to a nozzle on said bow housing;

(f) a water release means for regulating the fluid flow through said avenue of release, said water release means being attached to said housing and attached to a pull mechanism and actuated by the movement of said pull mechanism, said water release means being a spring biased pinch bar which clamps the flexible tube, thus restricting fluid flow therethrough;

(g) a pull mechanism attached to said housing and functionally connected to said water release means, wherein said pull mechanism actuates said pinch bar release by being pulled and released and by forcing a plunger against said pinch bar, said plunger being pushed by compressed air ahead of a spring locked piston; and, (h) a nozzle located on said housing, said nozzle being connected to said avenue of release.

12. The bow of claim 11, wherein said water storage reservoir is adapted to hold at least 100 pounds per square inch of pressure.

13. The bow of claim 11, wherein said means for pressurizing said water storage reservoir is a hand operated air pump.

14. The bow of claim 11, further including a bow string, wherein said pull mechanism is attached to said bow string and said pull mechanism and bow string may be pulled and released together to actuate said water release means.

15. The bow of claim 11, wherein said nozzle is positioned on said housing in a central location to simulate the positioning of an arrow.

16. The bow of claim 11, wherein said piston has a controlled return so as to regulate the amount of water exiting said nozzle.

17. The bow of claim 11, wherein said spring bias is calibrated to yield to pressure within said avenue of release, when said pressure within said avenue of release exceeds a predetermined value.

18. The bow of claim 11, wherein said spring bias is formed by an extension spring having two ends, one end being anchored to said housing and the other said end anchored to said pinch bar.

19. The bow of claim 11, wherein the flow of air from said water storage reservoir to said pressurizing means is prevented by a one way flow device.

20. The bow of claim 17, wherein said maximum value for the yielding of said spring bias to said pressure within said avenue of release is between about 50 pounds per square inch and about 90 pounds per square inch.

* * * * *